US005767759A

United States Patent [19]

Rouet

[11] Patent Number: 5,767,759

[45] Date of Patent: Jun. 16, 1998

[54] INDUCTOR WITH PLURAL LINEARLY ALIGNED SPACED APART FERRITE CORES

[75] Inventor: Pascal Rouet, Gouy, France

[73] Assignee: U.S. Philips Corporation, New York, N.Y.

[21] Appl. No.: 295,448

[22] Filed: Aug. 24, 1994

[30] Foreign Application Priority Data

Sep. 1, 1993 [FR] France ..... 93 10427

[51] Int. Cl.[6] ..... H01F 38/20; H01F 27/30; H01F 27/24

[52] U.S. Cl. ..... 336/174; 336/198; 336/212; 336/233

[58] Field of Search ..... 336/233, 198, 336/131, 174, 175, 212; 171/242; 323/76

[56] References Cited

U.S. PATENT DOCUMENTS

| | | | |
|---|---|---|---|
| 3,123,787 | 3/1964 | Shifrin | 336/229 |
| 3,173,080 | 3/1965 | Maeda | 323/76 |
| 3,491,300 | 1/1970 | Pawlowski | 325/49 |
| 3,662,306 | 5/1972 | Heins | 336/119 |
| 4,638,282 | 1/1987 | Ellison | 336/185 |

FOREIGN PATENT DOCUMENTS

| | | |
|---|---|---|
| 951963 | 11/1949 | France . |
| 1259976 | 9/1962 | Germany . |
| 240899 | 9/1942 | Switzerland . |
| 240899 | 1/1946 | Switzerland . |

*Primary Examiner*—J. R. Scott
*Assistant Examiner*—Daniel Chapik
*Attorney, Agent, or Firm*—Edward Blocker

[57] ABSTRACT

An inductor has a winding arranged on a straight magnetic core formed by a plurality of ferrite cylinders disposed in line with one another with a space between adjacent cylinders. The ferrite cylinders are accommodated in a common cylinder made of a molded plastic material which has a helical groove in its outer cylindrical surface. The inductor is used for the injection of a low-frequency current into a cable of a CATV system.

17 Claims, 1 Drawing Sheet

INDUCTOR WITH PLURAL LINEARLY ALIGNED SPACED APART FERRITE CORES

BACKGROUND OF THE INVENTION

This invention relates to an inductor comprising a winding arranged on a straight magnetic core having at least one gap.

The invention also relates to a method of manufacturing such an inductor.

Such an inductor is used for injecting a low-frequency current of, for example, approximately ten amperes with a frequency of 50 Hz or 60 Hz, into a cable of a television distribution system in order to power various devices.

An inductor comprising a winding arranged on a straight magnetic core having air gaps is known from French patent no. 951,963. Said patent describes an inductor intended for low-frequency use (discharge lamps), whose saturation threshold is to be adjusted and which for this purpose has one or more recesses in a straight core. The document does not describe the inductor performance as regards the attenuation of high-frequency currents.

An inductor intended for this purpose should have an impedance which is high enough to block high-frequency television signals and to allow the passage of low-frequency alternating current. The inductor should also exhibit minimal parasitic resonances in order not to disturb the pass band of the distribution system between 5 MHz and over 1 GHz. Moreover, in such a distribution system the high-frequency signals are subject to spurious modulation with the power supply frequency (hum modulation) owing to non-linearities caused by hysteresis and saturation effects in the material of the core of the inductor.

SUMMARY OF THE INVENTION

It is an object of the invention to attenuate in particular the hum modulation while maintaining a sufficiently high impedance for high-frequency signals, without the inductor volume being increased excessively. The invention makes use of the saturation characteristics of open cores as a function of their geometry and of the property of the spread of magnetic fields in an open core as a function of the frequency. Thus, an inductor in accordance with the invention is characterised in that said magnetic core is formed by a plurality of cylinders disposed in line with one another with a spacing between adjacent cylinders. Of course, it should be obvious that the term magnetic core is used interchangeably with the term ferromagnetic core.

At low frequencies (50 Hz) the saturation depends mainly on the geometry of the core and, in particular, on its length. For a given excitation current in the inductor the saturation decreases as the length of an open core decreases. By combining a plurality of spaced-apart open cores the saturation of the combination is reduced and the inductance decreases at low frequencies, but this is of little importance. However, as the frequency increases the permeability of the core material decreases, more and more lines of force passing only partly through the material of the open cores, and the blocking inductance may then be regarded as a plurality of inductances in series, substantially without any coupling between them. Thus, the division of the core has only a small influence on the inductance value at high frequencies.

It is advantageous if the ferrite cylinders are accommodated in a common cylinder made of a moulded plastics material. It is also advantageous if the cylinder of a moulded plastics material has a helical groove in its outer cylindrical surface.

By means of this groove the wire can be guided during winding and can be kept in place subsequently.

Moreover, spurious modulation is caused not only by the saturation but also by possible vibrations. An additional advantage of accommodating the cores in a moulding and of the presence of the groove is that spurious modulation as a result of the last-mentioned cause is also reduced considerably because of the effective mechanical immobilisation of the wire as well as the cores.

Suitably, the number of ferrite cylinders is three. For an inductor intended for blocking signals of a frequency between 5 MHz and over 1 GHz while allowing the passage of currents of approximately ten amperes with a frequency of 50 Hz, the core preferably comprises three ferrite cylinders of the material ferroxcube 4B1 and of a diameter of between 7 and 13 millimeters, the cylinders having a length of between 8 and 16 millimeters each and being separated from one another by spacings of between 1 and 3 millimeters each, and the winding has a number of turns between 20 and 40, wound from a wire whose diameter is between 8 and 16 tenths of a millimeter.

A method of manufacturing an inductor in accordance with the invention is characterised in that the moulding is effected by hot injection-moulding of a thermoplastic material and the ferrite cores are held in position by means of pins during the injection-moulding. The pins leave pit-shaped marks in the plastics material but this does not pose any problem.

BRIEF DESCRIPTION OF THE DRAWING

These and other more detailed aspects of the invention will become apparent from the following description of a non-limitative embodiment.

DESCRIPTION OF THE PREFERRED EMBODIMENTS

Figure 1:
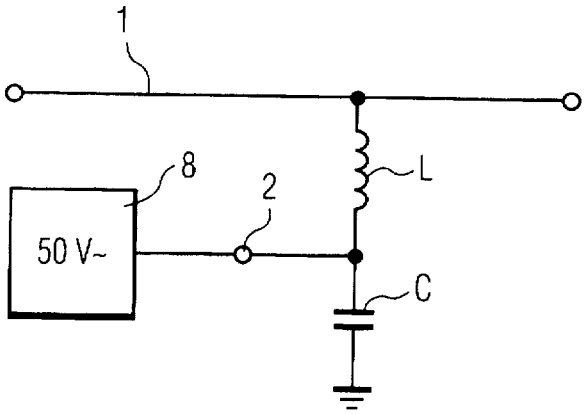
FIG. 1 is a diagram of the use of an inductor in accordance with the invention.

The device whose diagram is shown in FIG. 1 comprises a television distribution line or cable 1, which forms part of a television distribution system, and a device for applying a low frequency supply current, which device comprises:

- a power supply source 8 supplying, for example, a 50-Hz alternating voltage of 50 V, and connected to a terminal 2,
- an inductor L in accordance with the invention, which injects low-frequency current from the terminal 2 into the line 1, and
- a capacitor C which provides high-frequency decoupling of the low end of the inductor L.

The relevant current is usually in the range between eight and twelve amperes.

Figure 2:
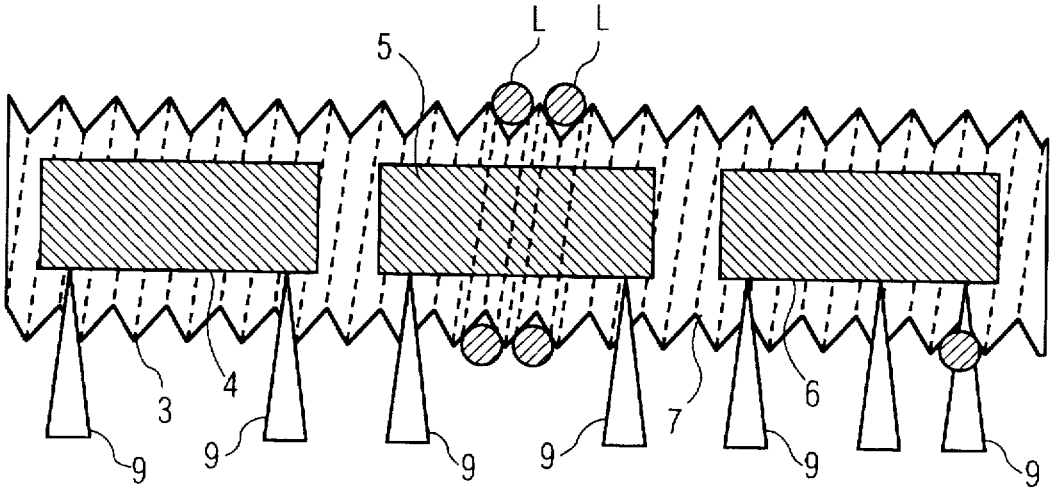
FIG. 2 is an axial sectional view of a cylindrical core for an inductor in accordance with the invention.

The magnetic core in accordance with the invention, shown in FIG. 2, comprises three ferrite cylinders 4, 5, 6 which are disposed in line with a space between adjacent cylinders.

A cylinder 3 of a plastics material is moulded around said ferrite cylinders which are held in position by pins 9 during injection molding. This moulded plastics cylinder 3 has a helical groove 7 in its outer cylindrical surface which supports a winding L (only partially shown).

The dimensions of such an inductor can be adjusted by adapting the spacing between the ferrite cylinders, the number of cylinders and the length of the individual cylinders. Interesting results have been obtained with an inductor having the following characteristics: the core comprises three ferrite cylinders of the material Ferroxcube 4B1, i.e. a nickel-zinc magnetically soft ferrite, and of 10 mm diameter, the cylinders each having a length of 12 mm and being separated from one another by spacings of 2 mm each. The winding has 24 turns wound from a wire of $10/10_{th}$ of a millimeter.

For the manufacture of an inductor in accordance with the invention use is made of hot injection-moulding of a thermoplastic material and the ferrite cores are held in position by means of pins during the injection-moulding.

I claim:

1. An inductor comprising:

a common plastic cylinder having a helical groove in its outer surface which accommodates a continuously wound winding, and a straight magnetic core comprising a plurality of ferromagnetic cylinders disposed in line with one another with a space between adjacent ferromagnetic cylinders, said ferromagnetic cylinders being held in a fixed position within the common cylinder such that said winding at least partly surrounds all of said ferromagnetic cylinders.

2. An inductor as claimed in claim 1, wherein the cylinders comprise ferrite cylinders and the common cylinder is made of an injection moulded plastic material.

3. An inductor as claimed in claim 1, wherein the cylinders comprise three ferrite cylinders.

4. An inductor as claimed in claim 1 for blocking signals of a frequency between 5 MHz and over 1 GHz while allowing the passage of 50 Hz currents of approximately ten amperes, wherein the core comprises three ferrite cylinders of nickel-zinc magnetically soft ferrite material of a diameter of between 7 and 13 millimeters, the cylinders each having a length of between 8 and 16 millimeters and being separated from one another by spacings of between 1 and 3 millimeters each, and the winding has between 20 and 40 turns, wound from a wire whose diameter is between 8 and 16 tenths of a millimeter.

5. The inductor as claimed in claim 2 which comprises three ferrite cylinders each of a length between 8 mm and 16 mm and wherein each said space is between 1 mm and 3 mm.

6. The inductor as claimed in claim 1 wherein said winding is in fixed magnetic coupling relationship to all of said plurality of ferromagnetic cylinders.

7. The inductor as claimed in claim 1 wherein the spacing between adjacent ferromagnetic cylinders is fixed and is substantially less than the length of said adjacent ferromagnetic cylinders.

8. A method of making an inductor having a common plastic cylinder with a winding thereon and which contains a plurality of ferromagnetic cylinders disposed in a line with a space between adjacent cylinders, the method comprising: hot injection-moulding of a thermoplastic material while holding the ferromagnetic cylinders in position by means of pins, subsequently removing the pins and cooling the thermoplastic material to form the common plastic cylinder containing a plurality of spaced feromagnetic cylinders, and placing a conductor around the common plastic cylinder.

9. A high frequency inductor comprising:

a plurality of linearly aligned magnetic cylinders forming a magnetic core and with a space between adjacent cylinders, an elongate housing in which the magnetic cylinders are disposed, and a winding wound around the outside of the housing so as to at least partly surround all of said magnetic cylinders.

10. The high frequency inductor as claimed in claim 9 wherein the cylinders are made of a ferrite material and the housing comprises a common plastic cylinder.

11. The high frequency inductor as claimed in claim 10 wherein said magnetic core cylinders only contact said common plastic cylinder and are fixed in position relative to one another.

12. The high frequency inductor as claimed in claim 9 wherein the housing comprises a common plastic cylinder directly molded around the magnetic cylinders, so as to surround and directly contact the magnetic cylinders, and to fill said space between adjacent magnetic cylinders, and with a uniform radius at least throughout the length of said plurality of linearly aligned magnetic cylinders.

13. The high frequency inductor as claimed in claim 10 wherein the common plastic cylinder has a helical groove in its outer cylindrical surface and said winding is the only winding magnetically coupled to the plurality of linearly aligned magnetic cylinders.

14. The high frequency inductor as claimed in claim 10 which comprises three magnetic cylinders fixed in position within the common plastic cylinder with their positions defined only by the material of the common plastic cylinder.

15. A television system comprising:

a television distribution line, an AC voltage power supply supplying a low frequency AC voltage at its output, a high frequency inductor as claimed in claim 8 coupled between the output of said power supply and said television distribution line so as to couple a low-frequency current into the television distribution line, and a high frequency decoupling capacitor coupled to said power supply output and to a circuit point of reference potential.

16. An inductor for injecting a low frequency supply current into a cable which carries a high frequency signal, comprising:

a common cylindrical housing made of a molded plastic material having a helical groove in its outer cylindrical surface which contains a single continuously wound winding, and a plurality of ferromagnetic cylinders disposed in a line within the common cylindrical housing and with a space between adjacent cylinders, said ferromagnetic cylinders being held in a fixed position which is defined by the molded plastic material of the common cylindrical housing.

17. The inductor as claimed in claim 16, wherein the common cylindrical housing is directly molded around the ferromagnetic cylinders so that each space between adjacent ferromagnetic cylinders contains molded plastic material of the common cylindrical housing and integral therewith.

* * * * *